US009889068B1

(12) United States Patent
Bakhoum

(10) Patent No.: US 9,889,068 B1
(45) Date of Patent: Feb. 13, 2018

(54) PILL ORGANIZER

(71) Applicant: Ezzat G. Bakhoum, Milton, FL (US)

(72) Inventor: Ezzat G. Bakhoum, Milton, FL (US)

( * ) Notice: Subject to any disclaimer, the term of this patent is extended or adjusted under 35 U.S.C. 154(b) by 0 days.

(21) Appl. No.: 15/655,840

(22) Filed: Jul. 20, 2017

Related U.S. Application Data

(62) Division of application No. 14/866,932, filed on Sep. 26, 2015.

(51) Int. Cl.

| | |
|---|---|
| ***B65D 83/04*** | (2006.01) |
| ***A61J 1/03*** | (2006.01) |
| ***B65D 25/06*** | (2006.01) |
| ***A61J 7/04*** | (2006.01) |
| ***B65D 43/16*** | (2006.01) |

(52) U.S. Cl.
CPC . *A61J 1/03* (2013.01); *A61J 7/04* (2013.01); *B65D 25/06* (2013.01); *B65D 43/163* (2013.01); *A61J 2205/30* (2013.01)

(58) Field of Classification Search
USPC ..... 206/534, 538, 540, 534.1, 535, 536
See application file for complete search history.

(56) References Cited

U.S. PATENT DOCUMENTS 611,136 A * 9/1898 Mason ..... B65D 75/327 206/457
2,377,120 A * 5/1945 Apfelbaum ..... B65D 83/0481 206/536
3,703,955 A * 11/1972 Inacker ..... B65D 83/0445 206/532
4,561,544 A * 12/1985 Reeve ..... B65D 11/12 206/1.5
4,693,371 A * 9/1987 Malpass ..... B65D 1/36 206/534
4,749,085 A * 6/1988 Denney ..... A61J 7/0069 206/459.5
4,793,492 A * 12/1988 Halbich ..... A45C 11/24 206/538
4,848,587 A * 7/1989 Nipp ..... A61M 5/003 206/459.5
5,169,001 A * 12/1992 Scheibel ..... A61J 1/035 206/425
5,251,757 A * 10/1993 Relyea ..... B65D 83/0463 206/531
5,356,011 A * 10/1994 Romick ..... A61J 1/03 206/534
5,558,229 A * 9/1996 Halbich ..... A61J 7/04 206/499
5,788,974 A * 8/1998 D'Amico ..... A61J 7/04 206/438
6,733,095 B1 * 5/2004 Rieb ..... A47B 46/00 312/122

(Continued)

*Primary Examiner* — Jacob K Ackun

(57) ABSTRACT

The invention is a novel pillbox for storing medicines that overcomes the deficiencies in existing commercial products. Unlike existing products, in which medicine is loaded into the pillbox by opening a top lid, the present invention is a pillbox that allows side-loading and unloading, thereby eliminating the lids. Because the lids tend to break after extensive use, the elimination of the lids extends the lifetime of the pillbox. Another objective of the invention is to offer the user medicine compartments with sizes that can be easily modified, unlike existing products that only offer medicine compartments with fixed sizes.

13 Claims, 3 Drawing Sheets

(56) References Cited

U.S. PATENT DOCUMENTS

| | | | | |
|---|---|---|---|---|
| 7,757,843 | B2 * | 7/2010 | Katsis | A24F 27/00 206/1.5 |
| 8,333,281 | B2 * | 12/2012 | Saltsov | A61J 1/03 206/1.5 |
| 2003/0038053 | A1 * | 2/2003 | Bramen | B65D 43/164 206/538 |
| 2004/0004017 | A1 * | 1/2004 | Schmitt | A47J 47/02 206/459.5 |
| 2005/0045519 | A1 * | 3/2005 | Hirsch | A61J 7/0007 206/534 |
| 2006/0086640 | A1 * | 4/2006 | Luciano, Jr. | A61J 7/0069 206/534 |
| 2010/0012547 | A1 * | 1/2010 | Gardner | B65D 83/0445 206/570 |
| 2015/0041355 | A1 * | 2/2015 | Lopez Losada | G07F 17/0092 206/530 |

* cited by examiner

PILL ORGANIZER

CROSS-REFERENCE TO RELATED APPLICATION

This application is a Divisional application of U.S. application Ser. No. 14/866,932, filed on Sep. 26, 2015, in the name of Ezzat G. Bakhoum for "Novel Pill Organizer".

SUMMARY OF THE INVENTION

The invention is a novel pillbox for storing medicines that overcomes the deficiencies in existing commercial products. Unlike existing products, in which medicine is loaded into the pillbox by opening a top lid, the present invention is a pillbox that allows side-loading and unloading, thereby eliminating the lids. Because the lids tend to break after extensive use, the elimination of the lids extends the lifetime of the pillbox. Another objective of the invention is to offer the user medicine compartments with sizes that can be easily modified, unlike existing products that only offer medicine compartments with fixed sizes.

DETAILED DESCRIPTION OF THE INVENTION, AND PREFERRED EMBODIMENTS THEREOF

The problem of organizing prescription medicines has been extensively researched and solved in a number of ways in the prior art. Of particular importance are U.S. Pat. No. 7,624,890 (Noble et. al.) and the three US Patent Applications No. 2004/0089581 (Dienst), 2014/0251862 (Priebe et. al.), and 2014/0251863 (Priebe et. al.). Those prior art references show a pillbox that contains seven or more compartments for storing medicines, where each compartment is covered with a plastic lid that can be opened with a push-button. This prior art technology now exists in the marketplace. There are two potential problems, however, with the pillbox described in the mentioned references: 1) the plastic lids usually break after extensive use, and 2) because the AM and the PM medicine compartments usually have equal sizes, such a pillbox is not ideal for storing disproportionate quantities of medicine (where, for example, the owner needs to take substantially more medicine in the AM than in the PM). It is the objective of the present invention to solve these two problems.

Figure 1:
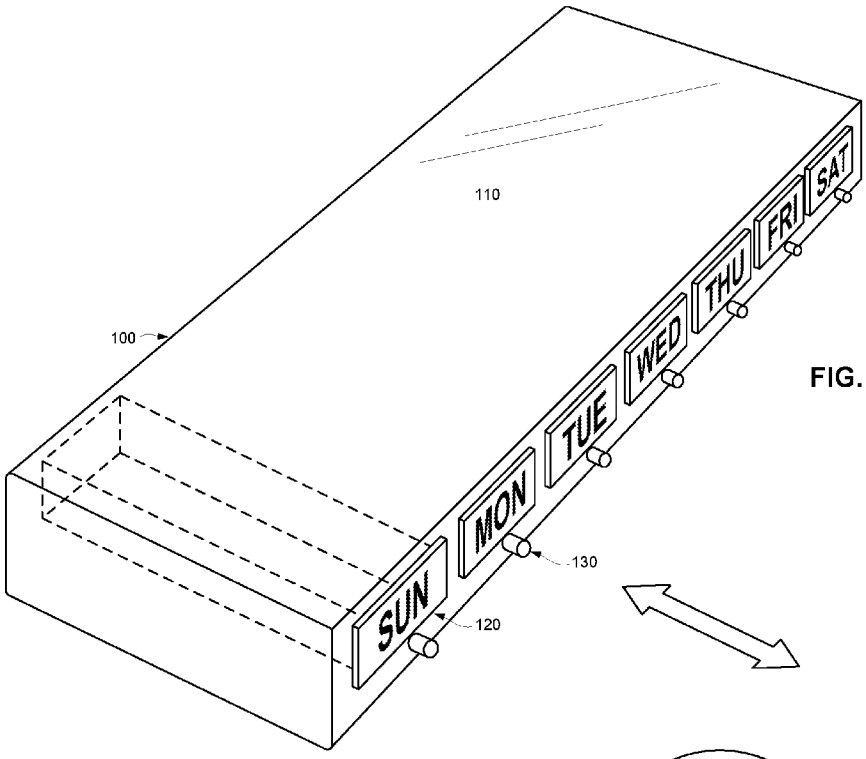
FIG. 1 is a sketch of one embodiment of the present invention. The figure shows a pillbox with drawer-shaped bins that open toward the side of the pillbox. A plurality of push-buttons are used for ejecting the drawers.
Figure 2:
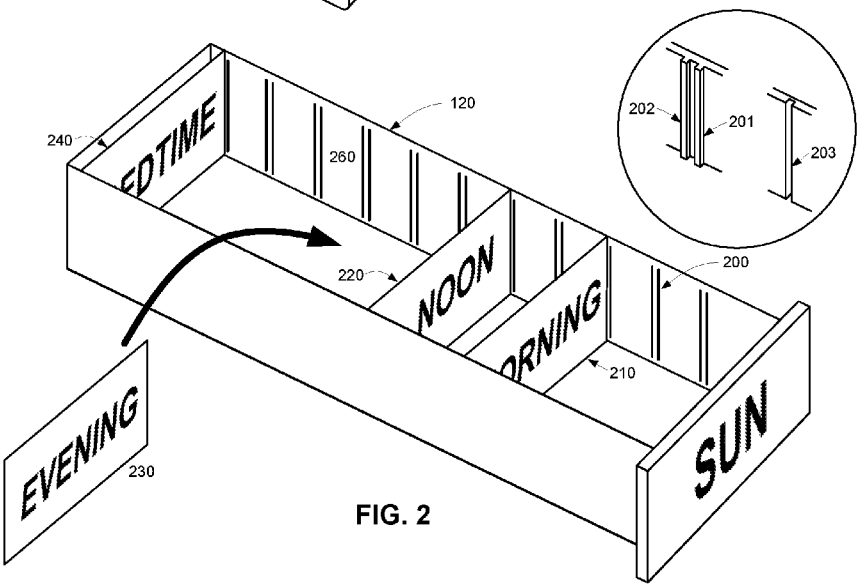
FIG. 2 shows the novel internal features of one of the drawers shown in FIG. 1.

Reference is now made to the drawings. FIG. 1 shows a plastic pillbox 100 that preferably contains a transparent top cover 110, so that the medicines inside the box can be clearly seen. Unlike the prior art, where the pills are loaded and unloaded through the top of the container, the present invention is based on side loading and unloading. As FIG. 1 shows, the pillbox contains 7 drawers (labeled SUN through SAT), starting with drawer 120. The drawers can be opened and closed through the side of the box, in the direction indicated by the arrows. In this manner, it is possible to store medicines without having to open a hinged plastic lid as shown in the prior art. FIG. 1 also shows a plurality of pins, such as pin 130, which act as push-buttons for ejecting the drawers (i.e., forcing the drawers to open). The drawers can be closed by simply pushing them back inside the box. The drawers can be labeled directly as shown in FIG. 1, or can be labeled indirectly by placing the text on the main container, in close proximity to the drawers FIG. 2 shows an expanded view of one of the drawers in FIG. 1. The second problem of the prior art is solved in the present invention by allowing the user to define his/her own compartment size. As shown in FIG. 2, the drawer contains a group of vertical guiding structures or vertical guiding structures 200, placed on the two internal sides of the drawer (the guides 200 can be either bulges on the surface of the plastic or grooves in the surface). A set of dividers, 210, 220, 230, and 240 can be inserted vertically and held in place by the guides 200, as the figure shows. The inset in FIG. 2 shows the guiding structure in detail. The bulges 201 and 202 can be used to secure the divider in place. Alternatively, a groove 203 can be used to accomplish the same task of securing the divider in place. The technique of securing a divider in place by means of two bulges or grooves in a surface is well-known in the prior art. The dividers are labeled "Morning", "Noon", "Evening", and "Bedtime", as shown. By inserting the dividers at arbitrary locations inside the drawer, four different compartments can be created, each with a different size. This solution, therefore, solves the second problem that is known in the prior art. (Note that the labeling may be in the form of adhesive-backed labeling or may be in the form of printing that is pre-applied to each divider)

Figure 3:
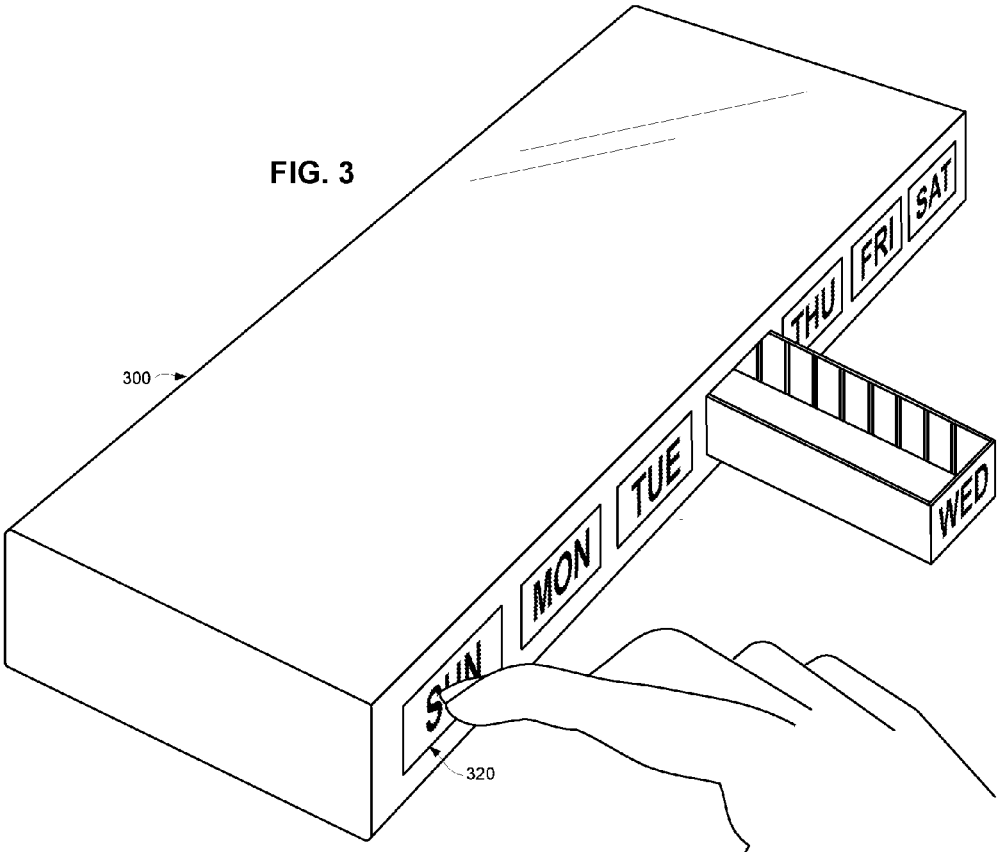
FIG. 3 is a sketch of the preferred embodiment of the present invention. The figure shows a pillbox with drawer-shaped bins that open toward the side of the box by simply applying finger pressure directly to the drawers.

FIG. 3 shows a different embodiment of the present invention, where the drawers (starting with drawer 320), can be opened and closed directly by simply pushing them into the pillbox with the user's finger. Each drawer is attached internally to a reciprocating latch mechanism (not shown in the figure, but very well known in the prior art), such that the drawer latches in place and remains closed if pushed once, and subsequently de-latches and moves to the outside if pressed once again. (Normally, such a latch mechanism would consist of two parts: one part in the drawer, and the other part in the container, as well known in the prior art). This alternative arrangement eliminates the need for the pins or push-buttons shown in FIG. 1.

Figure 4:
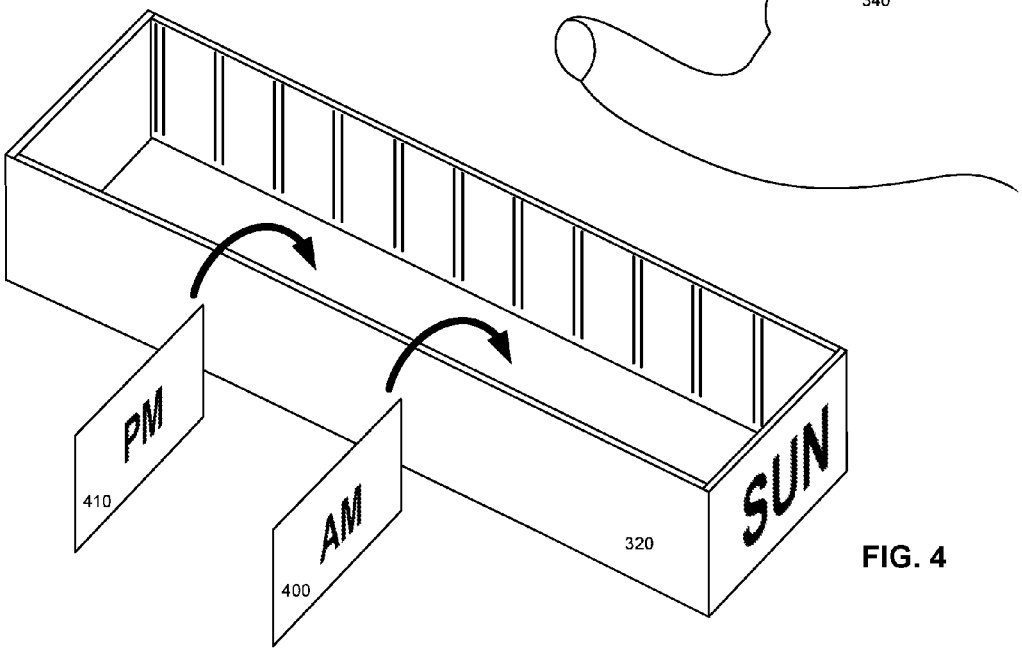
FIG. 4 shows another embodiment of one of the drawers used in the present invention.

FIG. 4 shows another expanded view of one of the drawers of the present invention, where, instead of four dividers, only two dividers (400 and 410), labeled "AM" and "PM", can be inserted inside the drawer. This solution can be used by the owner of the pillbox if only two compartments are needed inside the drawer.

Figure 5:
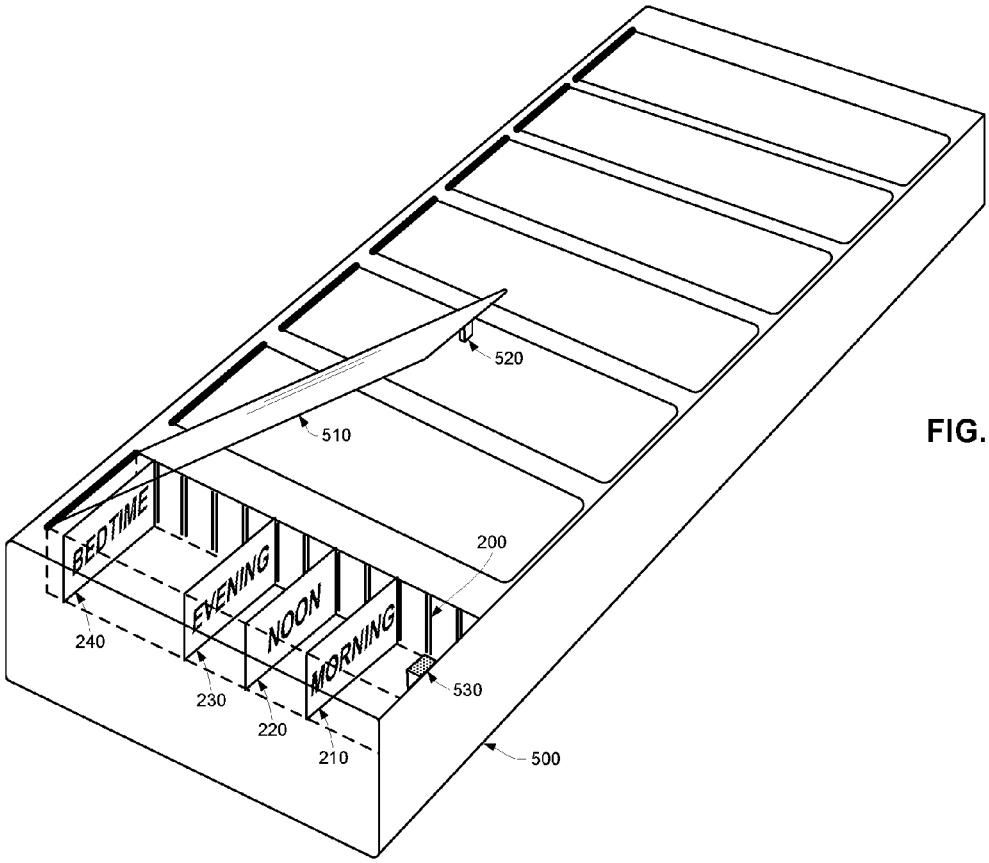
FIG. 5 shows a non-preferred embodiment of the invention, where medicines are loaded and unloaded through the top side of the pillbox.

FIG. 5 shows yet another embodiment of the present invention, although it is a non-preferred embodiment. As the figure shows, a group of hinged transparent lids, starting with lid 510, are mounted in the top cover of pillbox 500 for top-loading of medicine. Each lid can possibly include a tooth 520 that engages a reciprocating latch 530 for the purpose of opening and closing the lid by simply pressing on it. The difference between the configuration shown in FIG. 5 and the pillboxes shown in the prior art is the structure of the medicine bin. As the figure shows, the medicine bin, which holds medicine for one specific day, comprises side-guides (200) and a set of dividers (210, 220, 230, and 240) for arbitrarily configuring the bin into four, three, or two compartments, as desired.

The pillbox described hereinabove and its components (drawers, dividers, etc.) should preferably be made of plastic for simplicity and low cost. However, it is certainly possible to manufacture the pillbox and/or some of its components from wood or metal. Furthermore, while the drawers described hereinabove have been shown with specific features that allow the user to open and close such drawers, it will be recognized that other features, such as handles, can be used with the drawers without any departure from the scope of the invention. In addition, it will be readily recognized that the invention, when offered as a product, may include materials of different colors, and may also include decorations (such as, for example, cartoon illustrations of the sun and the moon) in order to be appealing to the user. Finally, it will be recognized that the labels that are attached to the dividers described hereinabove may be attached by the manufacturer or included separately in order to be attached later by the user. Accordingly, while the invention has been described hereinabove with reference to specific features and embodiments, it will be recognized by those skilled in the art that several variations are possible, and the invention is intended to encompass all possible variations and alternatives within its scope.

What is claimed is:

1. A portable container for storing medicine, comprising:

a) at least seven movable drawers that are labeled directly or indirectly with the days of the week;

b) a latch mechanism attached to each of said drawers for preventing the involuntary movement of the drawer;

c);

d) a plurality of guiding structures that are constructed on two internal planar surfaces inside each of said drawers;

e) at least one divider inside each of said drawers; said divider to be mounted and secured inside the drawer by means of two of said guiding structures; wherein said divider and said guiding structures are constructed and arranged to create at least one variable size compartment inside the drawer; and f) suitable labeling affixed to said at least one divider said labelling comprising indicia selected from the group consisting of "AM", "PM", "morning", "noon", "evening" and "bedtime".

2. A container according to claim 1, further comprising a transparent top cover.

3. A container according to claim 1, wherein said suitable labeling is to be affixed to said at least one divider by the end user.

4. A container according to claim 1, further comprising a plurality of buttons for ejecting said drawers.

5. A container according to claim 1, further comprising a plurality of internal latch mechanisms for securing the plurality of said drawers in place and for selectively releasing any of the drawers when finger pressure is applied to the drawer.

6. A container according to claim 1, made from a material that is selected from the group consisting of plastics, metals, or wood.

7. A drawer according to claim 1, made from a material that is selected from the group consisting of plastics, metals, or wood.

8. A divider according to claim 1, made from a material that is selected from the group consisting of plastics, metals, or wood.

9. A container according to claim 1, further including features with different colors.

10. A container according to claim 1, wherein two dividers, labeled "AM" and "PM", are used.

11. A container according to claim 1, wherein four dividers, labeled "Morning", "Noon", "Evening", and "Bedtime" are used.

12. A container according to claim 1, wherein said guiding structures are bulges in said internal planar surfaces of said drawer.

13. A container according to claim 1, wherein said guiding structures are grooves in said internal planar surfaces of said drawer.

* * * * *